United States Patent [19]

Hanyu

[11] Patent Number: 4,563,963

[45] Date of Patent: Jan. 14, 1986

[54] METHOD OF FORMING STOP STITCHES IN A COMPUTERIZED SEWING MACHINE

[75] Inventor: Susumu Hanyu, Tokyo, Japan

[73] Assignee: Janome Sewing Machine Co., Ltd., Tokyo, Japan

[21] Appl. No.: 602,416

[22] Filed: Apr. 20, 1984

[30] Foreign Application Priority Data

Apr. 21, 1983 [JP] Japan ..... 58-69233

[51] Int. Cl.[4] ..... D05B 3/02

[52] U.S. Cl. ..... 112/266.1; 112/451; 112/454

[58] Field of Search ..... 112/158 E, 317, 316, 112/266.1, 451, 454, 262.1

[56] References Cited

U.S. PATENT DOCUMENTS 4,266,493 5/1981 Hanyu et al. ..... 112/158 E 4,345,532 8/1982 Eguchi ..... 112/317

4,393,795 7/1983 Makabe et al. ..... 112/158 E

*Primary Examiner*—Peter Nerbun

*Attorney, Agent, or Firm*—Michael J. Striker

[57] ABSTRACT

A method of forming stop stitches in a computerized sewing machine which stores needle amplitude control signals and fabric feed signals for forming a plurality of stitching patterns, and temporarily stores a plurality of patterns in accordance with designation by an operation and pattern stitching order, having the steps of providing stop stitch designation to be combined with said operation for said temporary storage or to be operated by way of the stitching, storing a plurality of stop stitch patterns as combinations of signals of relative fine varying amount of stitching coordinate, and selecting, by means of a micro computer, desired stop stitch pattern from said plurality of stop stitch patterns in response to stitchings while forming the patterns and the stop stitches by said stop stitch designation.

3 Claims, 10 Drawing Figures

(1) Read pattern signal
(2) Select stop-stitch pattern
(3) Return
(4) Pattern (A)
(5) Sink feed dog
(6) Perform pattern (A) stop sewing machine
(7) Stop sewing machine
(8) End of pattern
(9) Perform pattern (B) stop sewing machine
(10) Coordinate more than 16
(11) Perform pattern (C) stop sewing machine
(12) Perform pattern (D) stop sewing machine
(13) Perform pattern (E) stop sewing machine (1) Read pattern signal
(2) Select stop-stitch pattern
(3) Return
(4) Pattern (A)
(5) Sink feed dog
(6) Perform pattern (A) stop sewing machine
(7) Stop sewing machine
(8) End of pattern
(9) Perform pattern (B) stop sewing machine
(10) Coordinate more than 16
(11) Perform pattern (C) stop sewing machine
(12) Perform pattern (D) stop sewing machine
(13) Perform pattern (E) stop sewing machine

METHOD OF FORMING STOP STITCHES IN A COMPUTERIZED SEWING MACHINE

BRIEF DESCRIPTION OF THE INVENTION

This invention relates to a method of forming stop stitches in a computerized sewing machine.

BACKGROUND OF THE INVENTION

In a computerized sewing machine, a stop stitch especially at the termination of a pattern is important to prevent fraying at the end of a stitch and to designate completion of the stitch. The sewing machine which selects a plurality of patterns of optional number and stores combinations of the patterns, makes combinations of one cycle of an optional pattern and a stop stitch after said optional pattern, designates this combination, performs the stop stitch at the end of the pattern, and stops the sewing machine. Since the stop stitch is not effective on the same position, it damages the thread. Therefore the position of the needle dropping is moved. But this movement is not in the needle amplitude direction, and determined patterns are prepared in dependence upon the movement of fine feed of the fabric such that the stop stitch may be applied to all of the patterns.

However, if the stop stitch pattern is used, the pattern is not made irregular by the stop stitch with respect to a straight stitch or such a pattern whose termination (a lower end) is parallel to a fabric feed direction (an upper part) as is seen in FIG. 1(A). If the pattern includes a directional component of the needle amplitude in the end of the pattern as shown in FIG. 1(B), the stop stitch pattern is varied only in the fabric feed direction, and the part of the stop stitch is made irregular.

SUMMARY OF THE INVENTION

An object of the present invention is to carry out the stop stitch by means of an appropriate stop stitching pattern in response to an end of the pattern just before the stop stitch. A memory of a micro computer stores stitch control signals for the stop stitching patterns, and when the stop stitching is performed, the micro computer selects a stop stitching pattern proper to the end of said pattern from a pattern number or a pattern stitching coordinate at performing said pattern.

DETAILED DESCRIPTION OF THE PREFERRED EMBODIMENTS

Figure 2:
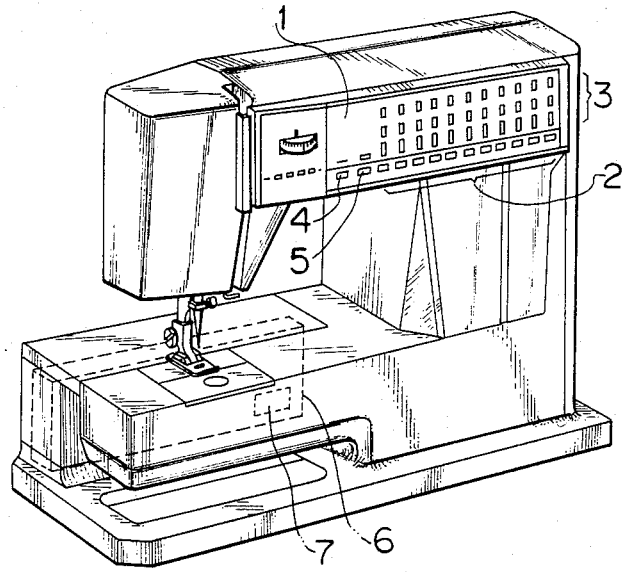
FIG. 2 is an outer appearance of a sewing machine showing an embodiment of the invention.

The present invention will be explained in reference to an embodiment shown in the attached drawings. FIG. 2 illustrates an outer appearance of a sewing machine showing an embodiment of the invention. A front panel 1 of the sewing machine is provided with a plurality of pattern selecting buttons 2, and a desired pattern is selected from a pattern indicator 3 by operation and operating number of the pattern selecting buttons 2. A stop stitch selection button 4 indicates a stop stitch at initial or final ends of an ordinary stitching pattern. A memory designating button 5 is operated in sequential association with operation of the pattern selecting buttons 2 or the stop stitch selection button 4 for indicating the memory coupled with a plurality of the patterns, or for indicating the memory to perform the stop stitches at the initial or final ends of the pattern.

Figures 3A, 3B, 3C, 3D, 3E:
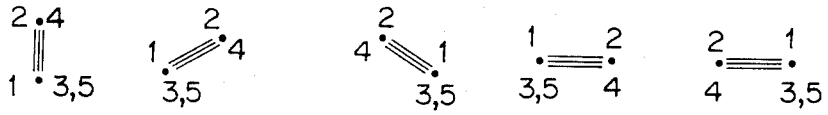
FIGS. 3(A) to (E) are examples of stop stitch patterns.

A control part 6 including a micro computer is housed in the sewing machine. A memory 7 of the micro computer stores stitch control signals for the stop stitching patterns, as shown in FIGS. 3(A) to (E), as the relative changing amount of stitch coordinates from 1 to 5. For example, the stop stitching pattern in FIG. 3(A) is stored as the amount of stitch coordinates is alternately varied in the forward and reverse directions of a fabric to be sewn.

FIG. 3(A) is a stop stitch pattern composed of fine feed of a fabric without needle amplitude. FIG. 3(B) is a stop stitch pattern composed of fine amplitude of a needle and fabric feed, starting at the left and ending at the right. FIG. 3(C) is a stop stitch pattern which changes similarly as in FIG. 3(B), starting at the right and ending at the left. FIGS. 3(D) and (E) are stop stitch patterns composed of fine needle amplitudes, starting at the left and ending at the right, or vice versa. These stop stitch patterns, for example, those of FIGS. 3(A), (B), (D) are applied to final ends of FIGS. 1(A), (C), (B) (lower ends), while the stop stitch patterns of FIGS. 3(C) and (E) are applied to the final ends of the inverted patterns of FIGS. 1(C) and (B).

Figures 1A, 1B, 1C:
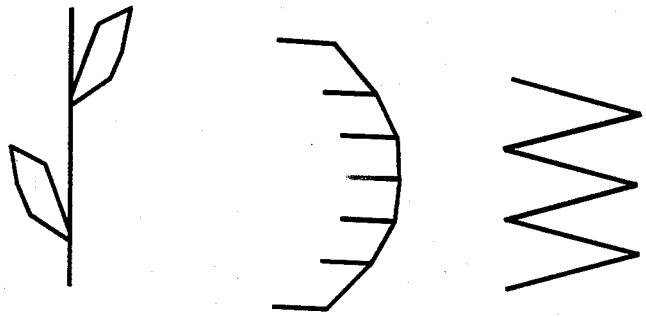
FIGS. 1(A), (B) and (C) are examples of stitching patterns according to the invention.

A further explanation will be made with respect to the operation of the stop stitching to be performed concerning the micro computer in reference to a flow chart shown in FIG. 4. In the embodiment, the needle amplitude is 7 mm in full length for the patterns such as shown in FIGS. 1(A), (B) and (C). The right end of the figure is coordinate 0 of the needle amplitude and the left end is coordinate 30, and the distance therebetween is equally divided into 30 parts. The sewing machine is independently provided with a detecting portion of a feed dog (not shown) when it is sunk.

Figure 4:
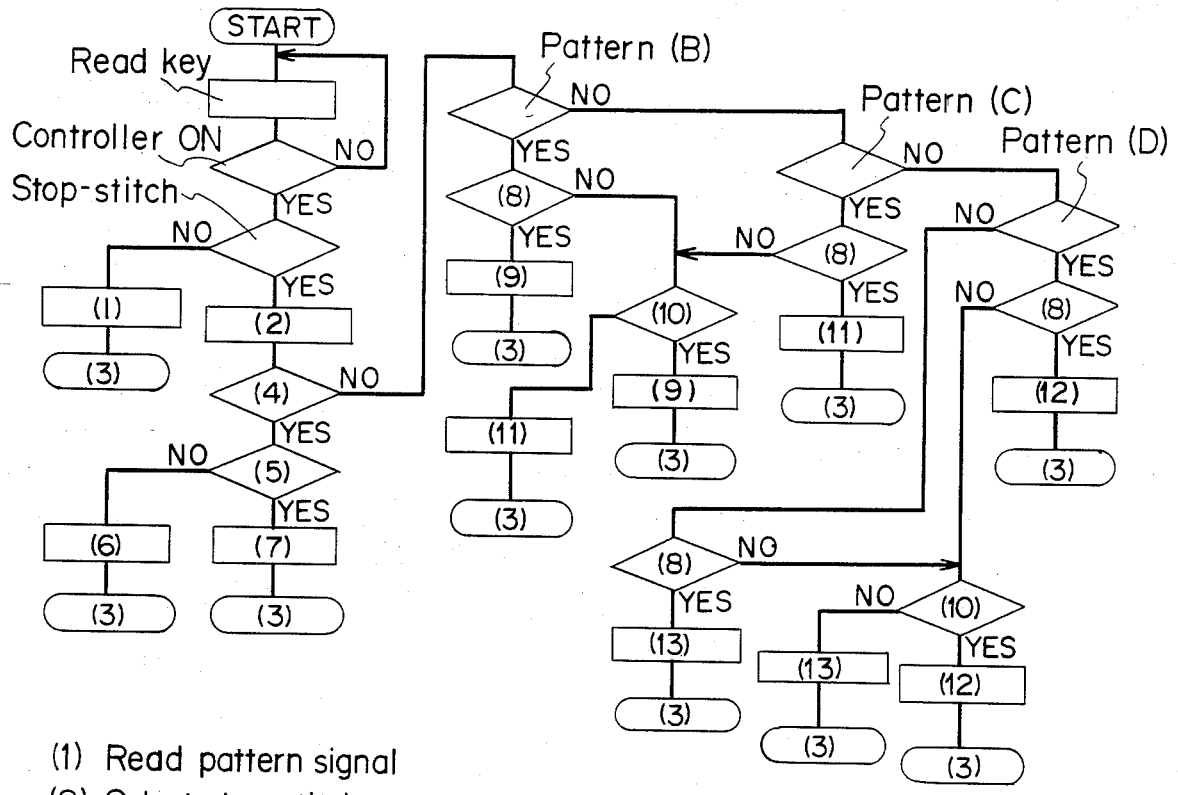
FIG. 4 is a control flow chart.

When a program shown in FIG. 4 starts, a pattern selecting button 2, a stop stitch selecting button 4 and a memory designating button 5 are read out, and when a machine controller (not shown) is operated, the stitching is begun and then it is discrminated whether or not the stop stitch is ordered. When the stop stitch is not ordered, the control part 6 outputs in succession stitch control signals of the ordered patterns, and when one cycle of this pattern is finished, the program returns to the start, So long as a new pattern selecting button 2 is not oerated in ordinary stitching, said pattern is repeatedly formed. While the memory designating button 5 is operated, a pattern to be next performed or the stop stitch is designated each time one cycle of the pattern is finished. When the stop stitch selection button 4 is operated during stitching operation, the stop stitch is ordered at this time. Then, the stop stitch pattern which has been in advance determined in response to each of the patterns, is selected from the stop stitch patterns shown in FIG. 3. Assuming that the stop stitch in response to said pattern is, for example, a pattern (A) in FIG. 3, it is discriminated whether the feed dog is sunk, and the sewing machine is stopped without performing the stop stitch, supposing that such a stitch which does not need the stop stitch as a basting stitch, is carried out, and the program is returned to the start. If the feed dog is not sunk, the stop stitch of the pattern in FIG. 3(A) is performed and the sewing machine is stopped. If the stop stitch pattern as shown in FIG. 3(B) is designated so as to be made at the end of one cycle of the selected pattern, the stop stitch pattern will be performed. If the designation is made during stitching of one of the selected patterns in FIG. 1 when the needle is located for example at coordinate 16 to the left of center coordinate 15 of the maximum swing amplitude of the needle, or when the needle is located at a coordinate at the leftward end of the swinging amplitude, the stop stitch pattern in FIG. 3(B) is performed, in which the stop stitch is started from the left to the right with slight variations, and then the sewing machine is stopped. The stitching direction of the stop stitch when the stop stitch is designated by way of the pattern cycle sometimes does not follow the stitching direction of the pattern just before the stop stitch. Although the pattern is interrupted as said above, the beautiful stitching is not requested, and therefore the stop stitch is in preference. If being not more than 16 stitches, that is, being positioned at the right in FIG. 1, the stop stitch of the pattern shown in FIG. 3(C) is carried out. With respect to designations of FIGS. 3(C), (D), (E) in response to the following patterns, the proper stop stitches are selected and performed.

As mentioned above, in accordance with the present invention, the proper stop stitch is selected and performed in response to the pattern just before the stop pattern or the stitching coordinate, and therefore the stop stitch is made beautiful and improved in its function.

While the invention has been illustrated and described as embodied in a computerized sewing machine, it is not intended to be limited to the details shown, since various modifications and structural changes may be made without departing in any way from the spirit of the present invention.

Without further analysis, the foregoing will so fully reveal the gist of the present invention that others can, by applying current inowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claim:

1. A method of forming stop stitches in a computerized sewing machine having a needle with a maximum needle swinging region having a plurality of needle positions, and a fabric feed dog, the sewing machine storing needle amplitude control signals and fabric feed signals for forming a plurality of stitch patterns, and also temporarily storing a plurality of patterns in accordance with a designation by an operation and pattern stitching order, the method comprising the steps of: storing a plurality of different stop stitch patterns as a combination of signals, each being substantially specific to individual stitch patterns of the plurality of stitch patterns; selecting a number of the stitch patterns so that they may be stitched in series; designating a stop stitch while said selected stitch patterns are being stitched; and selecting, by means of a micro-computer, a desired stop stitch pattern from said plurality of stop stitch patterns so that said desired stop stitch pattern is specific to a selected stitch pattern which is being stitched when said stop stitch designation is made, said micro-computer detecting whether the needle is in a position laterally of a center position of the maximum needle swinging region when said step of designating a stop stitch is performed, said micro-computer also determining the position of an initial stitch for said selected stop stitch pattern in dependence upon the detected needle position.

2. A method as defined in claim 1, wherein the sewing machine has a fabric feed direction, and said step of storing a plurality of different stop stitch patterns includes storing said stop stitch patterns as a combination of signals including signals for controlling the needle position laterally of the fabric feed direction.

3. A method as defined in claim 2, wherein said designating step includes designating by operating a single stop stitch designation button.

* * * * *